US009328733B2

(12) United States Patent
Oh

(10) Patent No.: US 9,328,733 B2
(45) Date of Patent: May 3, 2016

(54) VACUUM PUMP OF VEHICLE PREVENTING LUBRICANT FROM REINTRODUCING FOR REDUCING OPERATION NOISE

(71) Applicant: Hyundai Motor Company, Seoul (KR)

(72) Inventor: Chunghan Oh, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 85 days.

(21) Appl. No.: 14/104,920

(22) Filed: Dec. 12, 2013

(65) Prior Publication Data

US 2015/0017045 A1 Jan. 15, 2015

(30) Foreign Application Priority Data

Jul. 9, 2013 (KR) ..... 10-2013-0080308

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 29/06*** | (2006.01) |
| ***F04C 2/344*** | (2006.01) |
| ***F04C 29/12*** | (2006.01) |
| ***F04C 18/344*** | (2006.01) |
| ***F04C 18/356*** | (2006.01) |
| ***F04C 25/02*** | (2006.01) |
| ***F04C 29/02*** | (2006.01) |

(52) U.S. Cl.

CPC ..... *F04C 29/068* (2013.01); *F04C 2/344* (2013.01); *F04C 2/3441* (2013.01); *F04C 18/344* (2013.01); *F04C 18/3441* (2013.01); *F04C 18/3564* (2013.01); *F04C 25/02* (2013.01); *F04C 29/028* (2013.01); *F04C 29/12* (2013.01); *F04C 29/128* (2013.01); *F04C 2270/13* (2013.01); *F04C 2270/14* (2013.01)

(58) Field of Classification Search

CPC ..... F04C 2/344; F04C 2/3441; F04C 18/344; F04C 18/3441; F04C 18/3564; F04C 29/02; F04C 29/028; F04C 29/12; F04C 29/122; F04C 29/068; F04C 15/06

USPC ..... 418/15, 87, 91, 93, 254–255, 259, 418/266–268

See application file for complete search history.

(56) References Cited

U.S. PATENT DOCUMENTS

| | | | | |
|---|---|---|---|---|
| 2,106,959 | A * | 2/1938 | Phillips | 418/255 |
| 3,301,474 | A * | 1/1967 | Buchel | 418/15 |
| 4,286,933 | A | 9/1981 | Sakamaki et al. | |
| 4,589,829 | A * | 5/1986 | Ogawa | 418/259 |
| 6,790,019 | B1 | 9/2004 | Hinchey, Jr. | |

FOREIGN PATENT DOCUMENTS

| | | | | |
|---|---|---|---|---|
| CN | 202732342 | U | 2/2013 | |
| JP | 57186658 | A * | 11/1982 | 418/257 |

(Continued)

*Primary Examiner* — Theresa Trieu

(74) *Attorney, Agent, or Firm* — Morgan, Lewis & Bockius LLP

(57) ABSTRACT

A vacuum pump of a vehicle for reducing operation noise may include a rotor rotating in a space defined by a housing formed in a pump body at an eccentric position relative to a center of the space, a vane installed to the rotor to rotate eccentrically in the space, and an oil outlet passing through the pump body and formed at a predetermined height above a lower limit of the space such that, when lubricant in the space is discharged in a pressurized state by the vane, the lubricant is not reintroduced back into the space by gravity.

14 Claims, 8 Drawing Sheets

(56) References Cited

FOREIGN PATENT DOCUMENTS

| | | | | | |
|---|---|---|---|---|---|
| JP | 8-14174 | A | | 1/1996 | |
| JP | 2001-059482 | A | | 3/2001 | |
| JP | 2005-16353 | A | | 1/2005 | |
| JP | 2005-030290 | A | | 2/2005 | |
| KR | 2004026214 | A | * | 3/2004 | ..... F04C 18/02 |
| KR | 10-0836991 | B1 | | 6/2008 | |
| KR | 1020100015053 | A | | 2/2010 | |
| KR | 1020130013005 | A | | 2/2013 | |

* cited by examiner

VACUUM PUMP OF VEHICLE PREVENTING LUBRICANT FROM REINTRODUCING FOR REDUCING OPERATION NOISE

CROSS-REFERENCE(S) TO RELATED APPLICATIONS

The present application claims priority of Korean Patent Application Number 10-2013-0080308 filed Jul. 9, 2013, the entire contents of which application are incorporated herein for all purposes by this reference.

BACKGROUND OF INVENTION

1. Field of Invention

The present invention relates to a vacuum pump for a vehicle which is mounted to a vehicle so as to generate vacuum pressure; and, particularly, to a vacuum pump of a vehicle for reducing operation noise capable of reducing pressure pulsation in a section within which pressure varies rapidly during operation of the vacuum pump, resulting in a reduction of operation noise.

2. Description of Related Art

A vehicle is provided with a vacuum pump to generate vacuum pressure for driving a variety of devices operated by the vacuum pressure. For example, in a vehicle equipped with a diesel engine, vacuum pressure is required to operate devices such as a braking system to operate a brake, an EGR valve, a throttle body, and a VGT. In addition, also in a vehicle equipped with a gasoline engine, a vacuum pump is provided in order to maintain vacuum pressure at a certain level or less such that proper vacuum pressure is stably applied to a variety of devices.

However, in a conventional vacuum pump for a vehicle, there are problems in that noise occurs according to operation of the vacuum pump. That is, the vacuum pump includes a rotor rotating in a space defined by a housing and a vane which is eccentrically rotated within the housing by the rotor, and generates vacuum pressure in such a way to compress air within the space and discharge the compressed air to the outside while the vane rotates in an eccentric state.

In this case, lubricant to smoothly operate the vacuum pump for a vehicle is supplied into and discharged from the vacuum pump. During discharge of the lubricant, noise occurs according to operation of the vacuum pump for a vehicle.

Such noise does not greatly affect driving performance of the vehicle, but acts as a factor of degrading comfortableness because the noise is transferred to a driver and a passenger. In addition, since devices using vacuum pressure are increasing in the vehicle and thus operating time of the vacuum pump for a vehicle is increased, an unpleasant feeling is increased due to operation of the vacuum pump.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

Various aspects of present invention is directed to a vacuum pump of a vehicle for reducing operation noise, which has a structure capable of reducing noise according to operation of a vacuum pump mounted to a vehicle. Various other aspects of the present invention is directed to a vacuum pump of a vehicle for reducing operation noise capable of preventing a phenomenon in which pressure is rapidly changed at the time of reducing noise according to operation of a vacuum pump.

In accordance with various aspects of the present invention, a vacuum pump of a vehicle for reducing operation noise may include: a rotor rotating in a space defined by a housing formed in a pump body at an eccentric position relative to a center of the space; a vane installed to the rotor to rotate eccentrically in the space; and an oil outlet passing through the pump body and formed at a predetermined height above a lower limit of the space such that, when lubricant having been introduced into the space is discharged in a pressurized state by the vane, the lubricant is not reintroduced back into the space by gravity.

The oil outlet may be formed above the center of the space and below an upper limit of the space. The housing may be formed on an inside surface of the pump body and has a side groove formed adjacent to the oil outlet along a rotation direction of the vane, and the vane may pass through a front end of the side groove and then pass through a front end of the oil outlet, during rotation of the vane.

An installation angular section of the side groove may be greater than that of the oil outlet on the basis of the center of the space. An angle formed by a center of rotation of the rotor and both ends of the side groove may be 77 degrees to 81 degrees.

A back surface of the oil outlet opposite to an installation portion of the rotor and the vane may be provided with a discharge valve which includes a plate valve rotating by pressure of lubricant discharged through the oil outlet and a valve stopper limiting a rotation angle of the plate valve, and the valve stopper may be formed on a surface of the discharge valve and has a vent groove. The vent groove may have a depth of 0.2 mm to 0.6 mm and a width of 1.2 mm to 1.6 mm.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
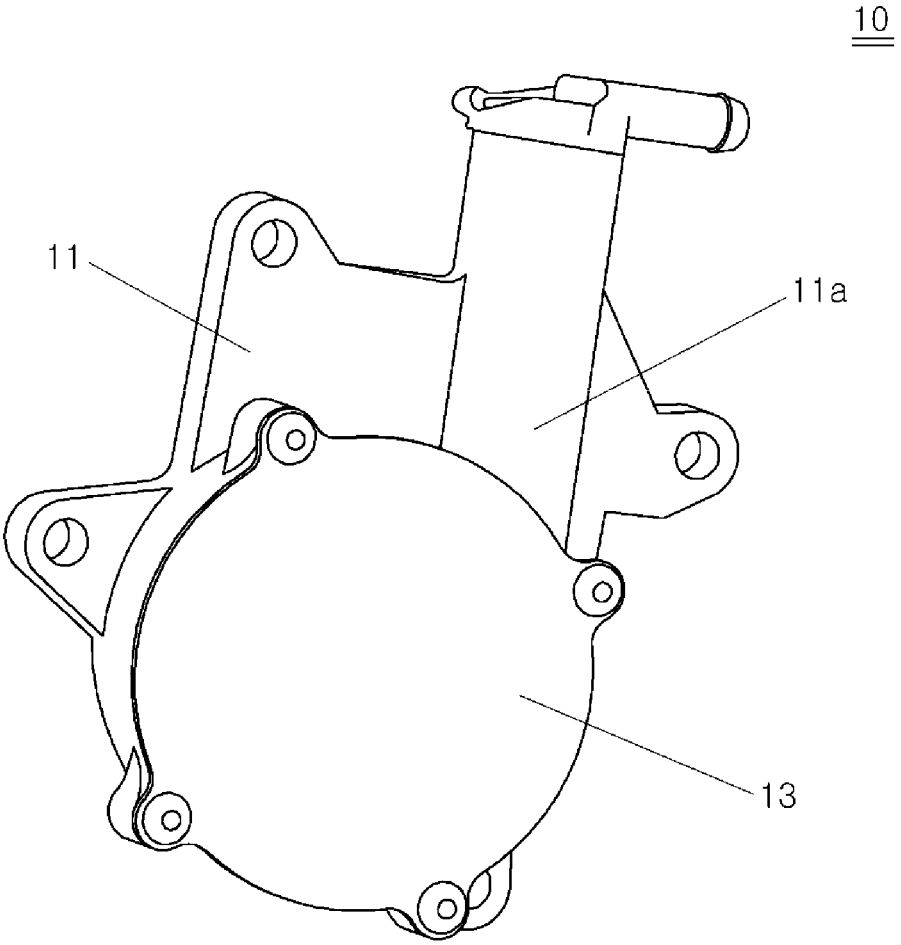
FIG. 1 is a perspective view illustrating an external appearance of an exemplary vacuum pump for a vehicle.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the vacuum pump of a vehicle for reducing operation noise according to various embodiments of the present invention, a description will be given of a structure of the vacuum pump for a vehicle in which air is discharged to the outside so as to generate vacuum. The vacuum pump has a structure in which a housing 12 is formed within a pump body 11 such that a space S is defined within the pump body 11, a rotor 14 is rotatably installed in the space S defined by the housing 12, and the rotor 14 is coupled to a vane 15 and the vane 15 is rotatable by the rotor 14. A center of rotation of the rotor 14 is positioned eccentrically relative to the housing 12. Accordingly, the vane 15 compresses air in the space and discharges the compressed air to the outside while rotating eccentrically, thereby generating vacuum pressure.

In the vacuum pump for a vehicle 10 having the above-mentioned structure, pressure is not relieved while lubricant discharged from the vacuum pump 10 according to operation thereof is introduced back into the vacuum pump 10 by gravity. In the meantime, the pressure is temporarily relieved to thereby cause pulsation, resulting in generation of vibration and noise. In order to resolve such a problem, in the vacuum pump for a vehicle 10 according to various embodiments of the present invention, an oil outlet 16, which is formed to pass through the pump body 11 such that lubricant is discharged through the oil outlet 16, is formed at a given or predetermined height above a lower limit of the space S defined within the pump body 11. The oil outlet 16 is formed at a given or predetermined height above the lower limit of the space S defined within the pump body 11, with the consequence that, once oil is discharged, the oil does not flow backward into the vacuum pump 10 by gravity.

Particularly, the oil outlet 16 is formed at an upper portion of the space in which the vane 15 rotates in the pump body 11. That is, the oil outlet 16 is formed above a center or center line of the space S and below an upper limit of the space S.

The vacuum pump for a vehicle 10 is configured such that lubricant is continuously supplied and discharged through the vacuum pump 10 to the outside in order to reduce friction due to operation thereof. The oil outlet 16 as a passage through which the lubricant is discharged from the inside of the pump body 11 to the outside thereof is formed at the upper portion of the space S in which the vane 15 rotates.

Figure 2:
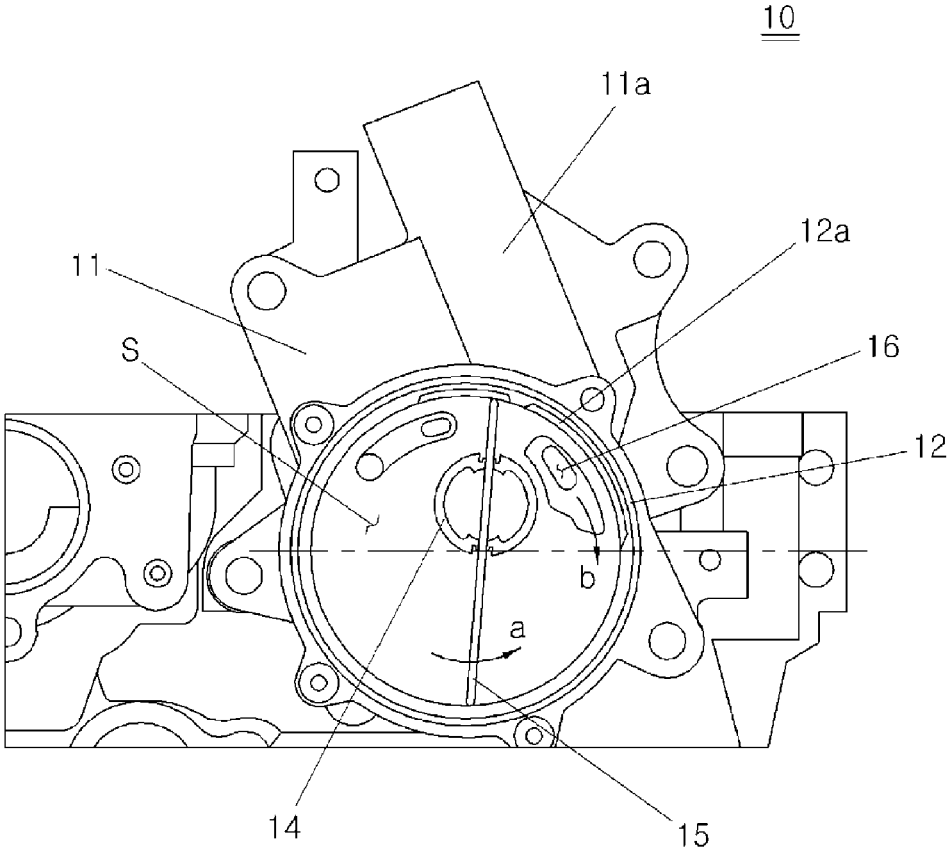
FIG. 2 is a front view illustrating a state of decoupling a cover from an exemplary vacuum pump of a vehicle for reducing operation noise in accordance with the present invention.

Since the oil outlet 16 is formed at the upper portion of the space S, lubricant discharged from the oil outlet 16 drops downward from the oil outlet 16 by gravity. Accordingly, the discharged lubricant is prevented from flowing backward into the oil outlet 16. If the oil outlet 16 is formed below the center of the space S, lubricant discharged from the oil outlet 16 may flow backward by gravity and be reintroduced into the oil outlet 16. When lubricant is reintroduced into the oil outlet, the reintroduced lubricant does not allow pressure to be relieved, thereby causing noise and vibration during operation of the vacuum pump 10. However, in the present invention, the oil outlet 16 is located at a certain height above the lower limit of the space S. Accordingly, since the discharged lubricant drops in a direction indicated by an arrow b in FIG. 2 and is then not reintroduced into the oil outlet 16, it may be possible to reduce noise and vibration due to backflow or reintroduction of the lubricant. When the discharged lubricant is prevented from flowing backward into the oil outlet 16, pressure relief in the vacuum pump 10 may be smoothly achieved. Consequently, it may be possible to reduce noise and vibration due to operation of the vacuum pump 10.

In addition, in the vacuum pump for a vehicle 10 according to various embodiments of the present invention, a side groove 12*a* is formed on an inside surface of the housing 12, and the side groove 12*a* is formed at a position adjacent to the oil outlet 16.

The vane 15 rotates while maintaining a state in which both side ends thereof come into contact with the inside surface of the housing 12 during rotation of the vane 15. In this case, the vane 15 passed through the oil outlet 16 in a partial section during rotation thereof, and rapid variation in pressure is generated at the moment in which the vane 15 comes into first contact with the oil outlet 16, resulting in generation of noise and vibration.

In order to prevent this, the side groove 12*a* is formed along a rotation direction of the vane 15 on the inside surface of the housing 12 with which both side ends of the vane 15 come into contact during rotation of the vane 15. The side groove 12*a* is preferably formed along a rotation direction of the vane 15 at a portion of coupling the housing 12 with the cover 13.

Figure 3:
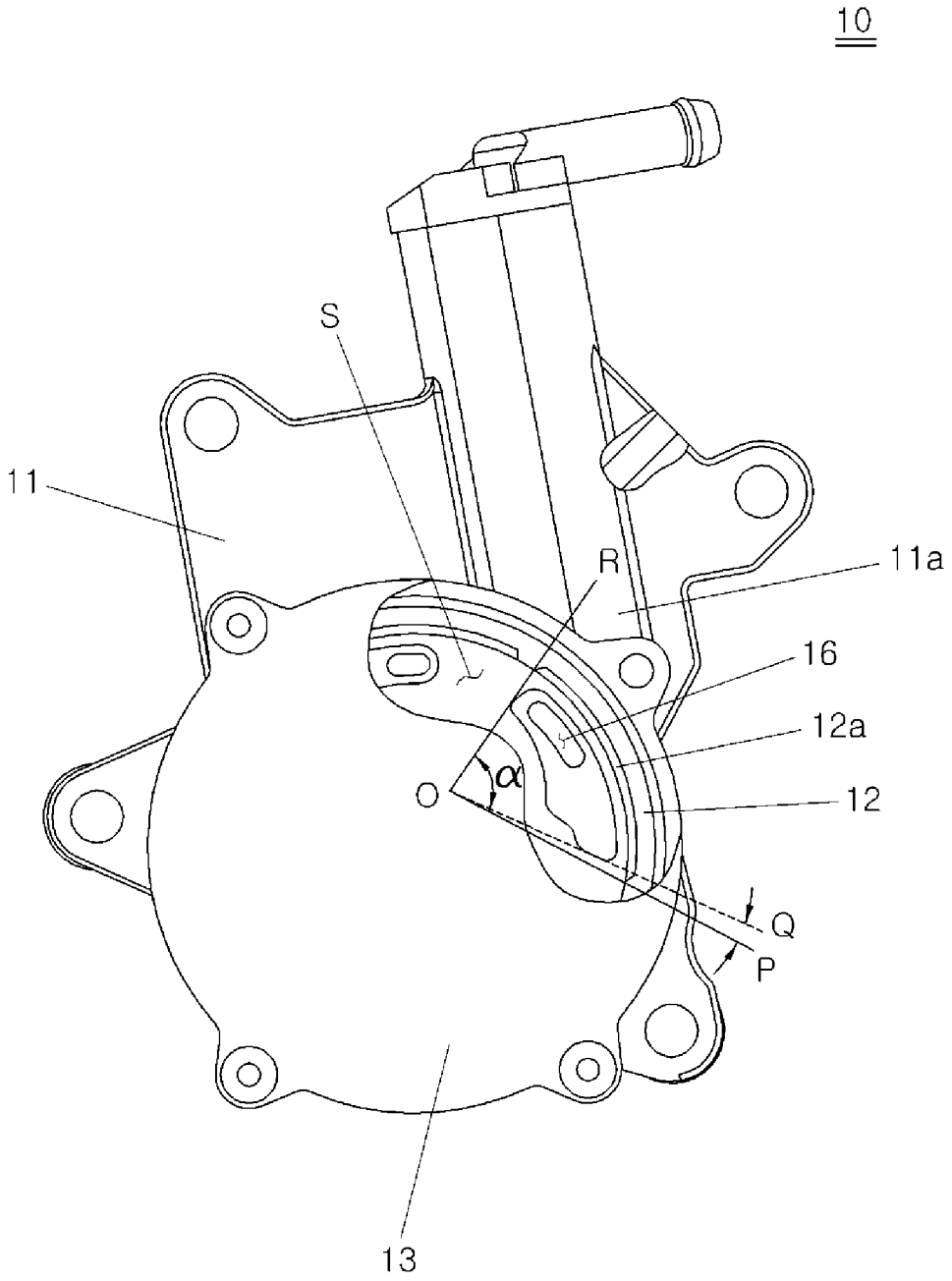
FIG. 3 is a front view illustrating formation of a side groove shown by cutting a portion of the cover from an exemplary vacuum pump of a vehicle for reducing operation noise in accordance with the present invention.

Particularly, a formation angle $\alpha$ of the side groove 12*a* ($\alpha$, an angle formed by line segment OP and line segment OR in FIG. 3) is preferably formed at an angle of 77 degrees to 81 degrees, more preferably at an angle of about 79 degrees, within a rotation section of the vane 15. FIG. 3 shows an example in which the side groove 12*a* is formed at an angle of about 79 degrees.

In this case, a front end of the side groove 12*a* (a portion at which the side groove 12*a* comes into first contact with the rotating vane) is located farther forward than a front end of the oil outlet 16, and thus the vane 15 comes into first contact with the side groove 12*a*. Consequently, pressure is partially relieved, thereby enabling noise due to operation of the vacuum pump 10 to be reduced. That is, in FIG. 3, line segment OP connecting the center of rotation O of the rotor 14 to the front end of the side groove 12*a* is located farther forward than line segment OQ connecting the center of rotation O of the rotor 14 to the front end of the oil outlet 16 in the rotation direction of the vane 15, so that the vane 15 comes into first contact with line segment OP prior to line segment OQ during rotation thereof.

An installation angular section of the side groove 12*a* is greater than that of the oil outlet 16 on the basis of the center of rotation O of the rotor 14. In addition, the side groove 12*a* may have a depth of about 3 mm.

Figure 4:
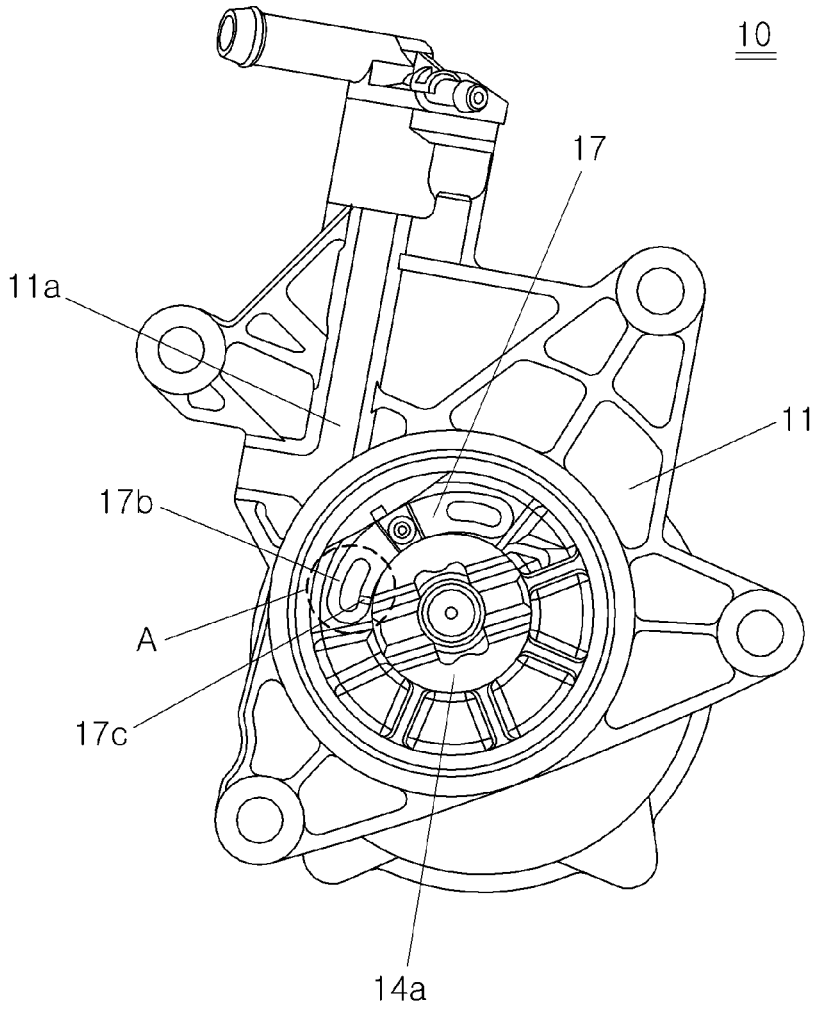
FIG. 4 is a back view illustrating an exemplary vacuum pump of a vehicle for reducing operation noise in accordance with the present invention.
Figure 5:
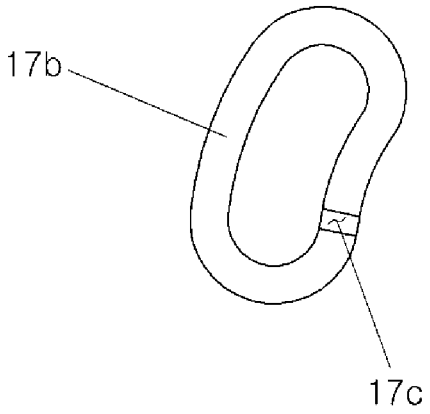
FIG. 5 is an enlarged view of portion "A" in FIG. 4.
Figure 6:
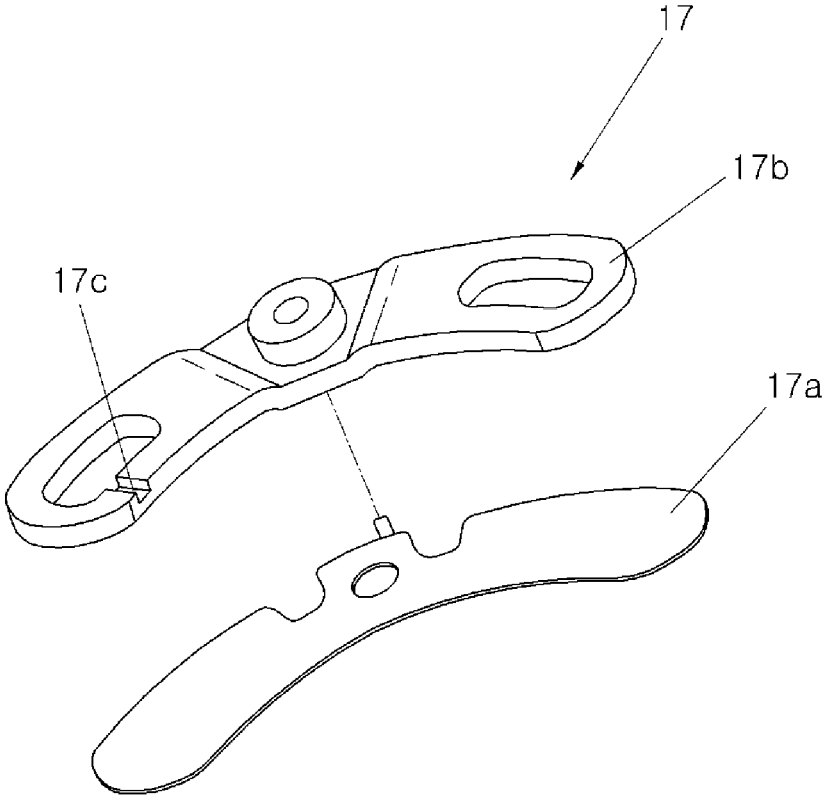
FIG. 6 is an exploded perspective view illustrating a discharge valve in an exemplary vacuum pump of a vehicle for reducing operation noise in accordance with the present invention.

As shown in FIG. 4, the vacuum pump 10 is formed, at a back surface thereof, with a discharge valve 17 to control discharge of lubricant, and a valve stopper 17*b* of the discharge valve 17 is formed with a vent groove 17*c*.

The discharge valve 17 is mounted inside the pump body 11 so as to cover the oil outlet 16, and includes a plate valve 17*a* pivoting by discharge pressure of the lubricant and a valve stopper 17*b* fixedly installed outside the plate valve 17*a* to limit an opening angle of the plate valve 17*a*. Here, the valve stopper 17*b* is formed, on an outside surface thereof, with the vent groove 17*c* formed from the surface of the valve stopper 17*b* in a radial direction thereof by a certain width and depth.

The vent groove 17*c* induces artificial mixing of air during discharge of the lubricant so as to absorb an impact caused during discharge of the lubricant by the air, thereby reducing noise and vibration. Here, the vent groove 17*c* may have a depth of 0.2 mm to 0.6 mm and a width of 1.2 mm to 1.6 mm.

Reference numeral 11*a* refers to an exhaust port through which compressed air is discharged to the outside, and non-described reference numeral 14*a* refers to a camshaft connection through which rotational force is transmitted to the rotor 14.

A description will be given of operation of the vacuum pump of a vehicle for reducing operation noise according to various embodiments of the present invention having the above-mentioned configuration.

First, lubricant supplied to the vacuum pump 10 by rotation of the rotor 14 and the vane 15 within the housing 12 is discharged through the oil outlet 16. Since the oil outlet 16 is located at a given or predetermined height in the space S in which the vane 15 rotates, namely, above the center of the space S, lubricant discharged through the oil outlet 16 is prevented from flowing backward and being reintroduced therein. Pressure is smoothly relieved since the lubricant is not reintroduced, thereby reducing noise and vibration caused by operation of the vacuum pump for a vehicle 10.

Figure 7A:
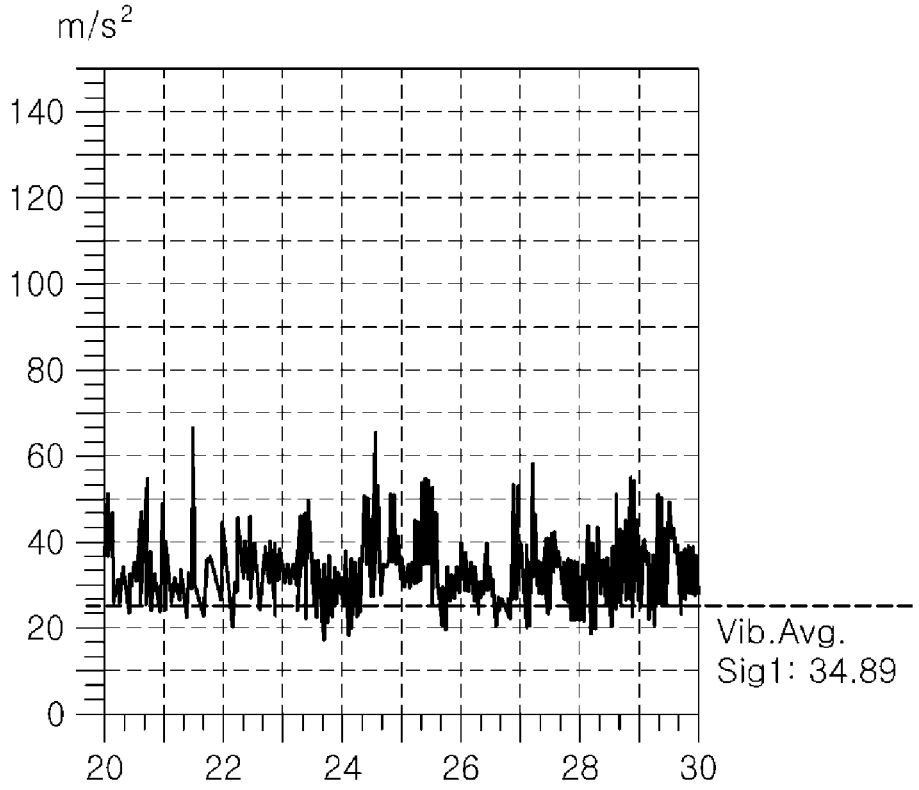
FIG. 7*a* and FIG. 7*b* are graphs illustrating vibration measured depending upon a position of an oil outlet in the vacuum pump of a vehicle for reducing operation noise in accordance with the present invention, FIG. 7*a* being a graph illustrating vibration measured in a state in which the oil outlet is formed at a lower portion of the vacuum pump and FIG. 7*b* being a graph illustrating vibration measured in a state in which the oil outlet is formed at an upper portion of the vacuum pump.
Figure 7B:
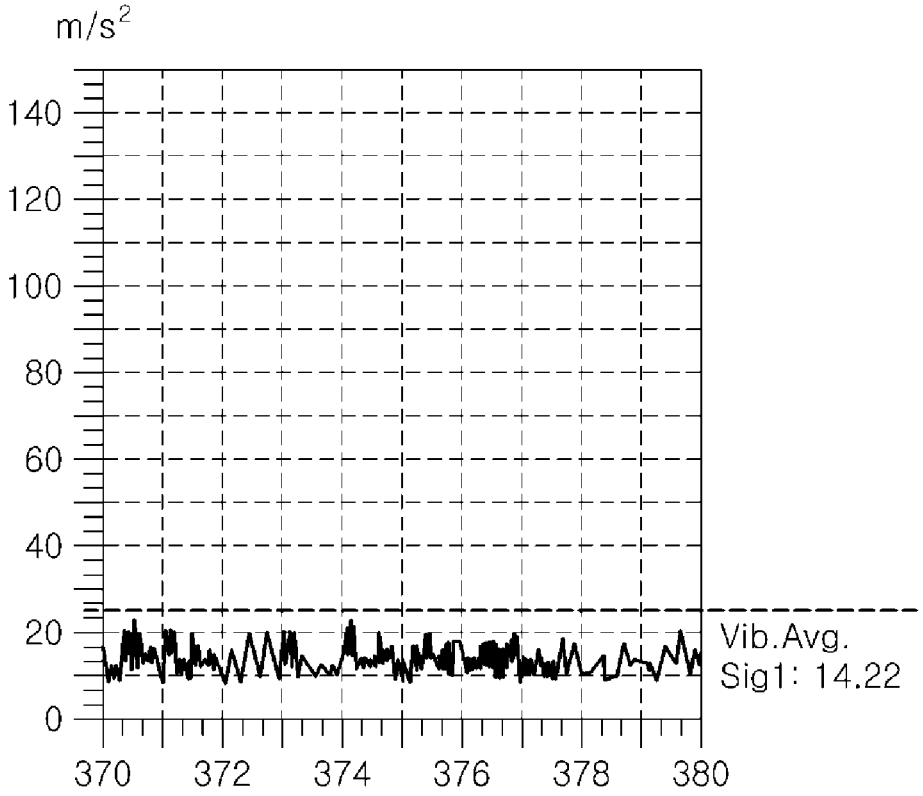

FIG. 7*a* and FIG. 7*b* show a vibration measurement result depending upon a position of the oil outlet 16. As shown, vibration is reduced when the oil outlet 16 is located above the center of the space S (see FIG. 7*b*), compared with being located below the center of the space S (see FIG. 7*a*). As shown in FIGS. 7*a* and 7*b*, since vibration according to operation of the vacuum pump 10 is low when the oil outlet 16 is located above the center of the space S (see FIG. 7*b*), compared with being located below the center of the space S (see FIG. 7*a*), the vibration is reduced. Accordingly, by installing the oil outlet 16 above the center of the space S in which the vane 15 rotates, it is possible to achieve attenuation of noise and vibration.

In addition, noise is reduced in a specific band by formation of the side groove 12*a*, compared with a housing without a side groove.

In addition, air is artificially mixed when lubricant is discharged from the vacuum pump 10 by formation of the vent groove 17*c*, resulting in a reduction of noise and vibration.

In accordance with a vacuum pump of a vehicle for reducing operation noise according to exemplary embodiments of the present invention, since an oil outlet through which lubricant is discharged is located above a center of a space in which a vane rotates, the lubricant is prevented from flowing backward during discharge thereof, thereby preventing noise due to backflow of the lubricant. In addition, since the vane comes into contact with a side groove prior to the oil outlet during rotation of the vane, pressure pulsation may be decreased to thereby reduce noise according to operation of the vacuum pump. Furthermore, air is discharged through a vent groove formed in a discharge valve, thereby reducing noise due to pressure pulsation.

For convenience in explanation and accurate definition in the appended claims, the terms "above" or "below", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vacuum pump of a vehicle for reducing operation noise, comprising:

a rotor rotating in a space defined by a housing formed in a pump body at an eccentric position relative to a center of the space;

a vane installed to the rotor to rotate eccentrically in the space; and an oil outlet passing through the pump body and formed at a predetermined height above a lower limit of the space such that, when lubricant having been introduced into the space is discharged in a pressurized state by the vane, the lubricant is not reintroduced back into the space by gravity, wherein a back surface of the oil outlet opposite to an installation portion of the rotor and the vane is provided with a discharge valve which comprises:

a plate valve rotating by pressure of lubricant discharged through the oil outlet; and a valve stopper limiting a rotation angle of the plate valve, wherein the valve stopper is formed on a surface of the discharge valve and has a vent groove, and wherein the vent groove has a depth of 0.2 mm to 0.6 mm and a width of 1.2 mm to 1.6 mm.

2. The vacuum pump of claim 1, wherein the oil outlet is formed above the center of the space and below an upper limit of the space.

3. The vacuum pump of claim 2, wherein:

the housing is formed on an inside surface of the pump body and has a side groove formed adjacent to the oil outlet along a rotation direction of the vane; and the vane passes through a front end of the side groove and then passes through a front end of the oil outlet, during rotation of the vane.

4. The vacuum pump of claim 3, wherein an installation angular section of the side groove is greater than that of the oil outlet on the basis of the center of the space.

5. The vacuum pump of claim 3, wherein an angle formed by a center of rotation of the rotor and both ends of the side groove is 77 degrees to 81 degrees.

6. A vacuum pump of a vehicle for reducing operation noise, comprising:

a rotor rotating in a space defined by a housing formed in a pump body at an eccentric position relative to a center of the space;

a vane installed to the rotor to rotate eccentrically in the space; and an oil outlet passing through the pump body and discharging lubricant from the space in a pressurized state by the vane, wherein the housing is formed on an inside surface of the pump body and has a side groove formed adjacent to the oil outlet along a rotation direction of the vane, and wherein the vane passes through a front end of the side groove and then passes through a front end of the oil outlet, during rotation of the vane, and wherein a vent groove of a discharge valve that controls discharge of the lubricant from the oil outlet has a depth of 0.2 mm to 0.6 mm and a width of 1.2 mm to 1.6 mm.

7. The vacuum pump of claim 6, wherein an installation angular section of the side groove is greater than that of the oil outlet on the basis of the center of the space.

8. The vacuum pump of claim 6, wherein an angle formed by a center of rotation of the rotor and both ends of the side groove is 77 degrees to 81 degrees.

9. The vacuum pump of claim 6, wherein the oil outlet is formed above the center of the space and below an upper limit of the space such that, when lubricant introduced into the space is discharged in the pressurized state by the vane, the lubricant is not reintroduced back into the space by gravity.

10. The vacuum pump of claim 6, wherein a back surface of the oil outlet opposite to an installation portion of the rotor and the vane is provided with the discharge valve which comprises:

a plate valve rotating by pressure of lubricant discharged through the oil outlet; and a valve stopper limiting a rotation angle of the plate valve, wherein the valve stopper is formed on a surface of the discharge valve and has the vent groove.

11. A vacuum pump of a vehicle for reducing operation noise, comprising:

a rotor rotating in a space defined by a housing formed in a pump body at an eccentric position relative to a center of the space;

a vane installed to the rotor to rotate eccentrically in the space;

an oil outlet passing through the pump body and discharging lubricant from the space in a pressurized state by the vane; and a discharge valve provided on a back surface of the oil outlet opposite to an installation portion of the rotor and the vane, the discharge valve including:

a plate valve rotating by pressure of lubricant discharged through the oil outlet; and a valve stopper limiting a rotation angle of the plate valve, wherein the valve stopper is formed on a surface of the discharge valve and has a vent groove, wherein the vent groove has a depth of 0.2 mm to 0.6 mm and a width of 1.2 mm to 1.6 mm.

12. The vacuum pump of claim 11, wherein:

the housing is formed on an inside surface of the pump body and has a side groove formed adjacent to the oil outlet along a rotation direction of the vane; and the vane passes through a front end of the side groove and then passes through a front end of the oil outlet, during rotation of the vane.

13. The vacuum pump of claim 11, wherein an installation angular section of the side groove is greater than that of the oil outlet on the basis of the center of the space.

14. The vacuum pump of claim 11, wherein an angle formed by a center of rotation of the rotor and both ends of the side groove is 77 degrees to 81 degrees.

* * * * *